252-99 AU 166 EX
6/9/81 OR 4,272,394

United States Patent [19]

Kaneko

[11] 4,272,394

[45] * Jun. 9, 1981

[54] MACHINE DISHWASHING DETERGENTS CONTAINING LOW-FOAMING NONIONIC SURFACTANTS

[75] Inventor: Thomas M. Kaneko, Trenton, Mich.

[73] Assignee: BASF Wyandotte Corporation, Wyandotte, Mich.

[ * ] Notice: The portion of the term of this patent subsequent to Jan. 13, 1998, has been disclaimed.

[21] Appl. No.: 95,818

[22] Filed: Nov. 19, 1979

[51] Int. Cl.[3] ..... C11D 7/54

[52] U.S. Cl. ..... 252/99; 252/135; 252/525; 252/544; 252/174.21; 252/174.22

[58] Field of Search ..... 252/99, 135, 525, 544, 252/174.21, 174.22

[56] References Cited

U.S. PATENT DOCUMENTS

| | | | |
|---|---|---|---|
| 3,314,891 | 4/1967 | Schmolka et al. | 252/174.21 |
| 3,359,207 | 12/1967 | Kaneko et al. | 252/99 |
| 3,635,827 | 1/1972 | Jacobi | 252/174.21 |

FOREIGN PATENT DOCUMENTS 1325645 8/1973 United Kingdom .

OTHER PUBLICATIONS

Preliminary Tech. Data, "Tetronic R Polyol Series", Sep. 1978.

Low Temperature, Nonphosphate, . . . Formulation Kaneko, May 1979.

*Primary Examiner*—Mayer Weinblatt

*Attorney, Agent, or Firm*—Andrew E. Pierce

[57] ABSTRACT

Machine dishwashing detergents containing a novel homogeneous blend of a conventional low-foaming nonionic surfactant and a second low foaming nonionic surfactant having relatively low cloud point unexpectedly provide effective detergency and result in dishes and other utensils being cleaned to a sparkling clean spot-free condition without the use of conventional phosphate ester defoamers such as monostearyl acid phosphate. The machine dishwashing detergent compositions of the invention are effective on dishes and other utensils encrusted with soils comprising egg and other milk-derived protein soils.

18 Claims, No Drawings

MACHINE DISHWASHING DETERGENTS CONTAINING LOW-FOAMING NONIONIC SURFACTANTS

BACKGROUND OF THE INVENTION

1. Field of the Invention

This invention relates to machine dishwashing detergent compositions and related processes.

2. Description of the Prior Art

In the art of cleaning compositions for use in cleaning hard surfaces, particularly the art of cleaning tableware and other food-soiled utensils in machine dishwashers, the problem of excessive foam buildup in the machine during operation as the result of high food soil concentrations has been largely solved by the use of alkyl phosphate ester defoamers such as monostearyl acid phosphate as disclosed in U.S. Pat. No. 3,314,891. Prior to such disclosure, machine dishwashing compositions had the tendency to foam excessively and/or leave undesirable spots and streaks on dishes and glassware. The low foaming nonionic surfactants contained in such detergent compositions were ineffective in both removing food soil and providing suitable foam control where the aqueous cleaning solution became contaminated with foam generating protein soils such as egg soil and soil from various milk products.

The generation of such foams is particularly insidious in that the cleaning action of the machine dishwasher depends to a large extent upon the effective suppression of foam generation during operation. Without effective foam suppression, the mechanical cleaning action of the machine dishwasher is reduced as the result of foam buildup in the aqueous cleaning solution so that the aqueous washing fluid which is normally impelled against the tableware in the machine dishwasher is less effective in cleaning because it is forced against the tableware at reduced pressure.

An indication of the various kinds of nonionic surfactants utilized in such machine dishwashing compositions can be found in the above patent and in U.S. Pat. No. 3,359,207. General disclosures of nonionic surfactants can be found in U.S. Pat. Nos. 2,677,700, 2,979,528, and 3,036,118. Low foaming washing and cleaning agents for use in machine dishwashing are also disclosed in U.S. Pat. No. 3,382,176. More recently, machine dishwashing detergent compositions based upon a non-phosphate salt builder have been disclosed in British No. 1,325,645; Canadian No. 941,707; U.S. Pat. Nos. 3,899,436; 4,127,496; and 4,092,258.

Recently a new series of nonionic surfactants has been disclosed, certain members of which possess relatively low cloud points as measured in a one percent aqueous solution. Such surfactants are suggested for use in the formulation of machine dishwashing detergents and generally for use where a defoamer is necessary. These new nonionic surfactants are termed TETRONIC® R polyols and are produced by the sequential block polymerization of ethylene oxide and propylene oxide utilizing, as polymerization initiator, a propoxylated ethylenediamine sold under the trademark QUADROL®. The TETRONIC® R polyols were introduced to the trade in September, 1978.

In no one of the above prior art references is there disclosed the use of a novel homogeneous blend of a conventional low foaming nonionic surfactant and a second nonionic surfactant wherein said second surfactant is characterized by a relatively low cloud point, i.e., about 10° C. to about 20° C. in a 1 percent aqueous solution. Said blend is useful in formulating machine dishwashing detergents which are capable of effectively controlling foaming during dishwasher operation caused by protein soil contamination.

SUMMARY OF THE INVENTION

Novel low foaming nonionic surfactants are disclosed which are useful in formulating machine dishwashing detergents. The use of a novel homogeneous blend of surfactants permits the elimination of the conventionally used alkyl phosphate ester, the prior art defoamer component of conventional machine dishwashing detergents which is immiscible with most conventional low-foaming nonionic surfactants. The machine dishwashing detergents of the invention are useful when formulated with phosphate or non-phosphate builders and other conventional adjuvants utilized in the formulation of machine dishwashing detergents. Because of the relatively low cloud point of one of the components of the nonionic surfactant blend, the machine dishwashing detergents of the invention can be utilized over a wide range of operating conditions. Wash water temperatures as low as 100° F. and as high as 180° F. and detergent concentrations of 0.2 to about 1 percent by weight can be utilized.

DESCRIPTION OF THE PREFERRED EMBODIMENTS

The novel nonionic surfactant blend of the invention useful in the preparation of machine dishwashing detergents of the invention contains a homogeneous mixture of nonionic surfactants comprising at least one conventional nonionic surfactant possessing low foaming characteristics and a second nonionic surfactant characterized by relatively low cloud point and a total molecular weight generally of about 500 to about 25,000. The proportion of surfactants in said blend is about 10 to about 90 percent by weight of each of the surfactants, preferably about 25 to about 75 percent by weight of each of the surfactants.

The Conventional Nonionic Surfactant

The conventional nonionic surface active agents which are advantageously employed in the nonionic surfactant blends and machine dishwashing detergent compositions of the invention can be the polyoxyalkylene adducts of hydrophobic bases wherein the oxygen/carbon atom ratio in the oxyalkylene portion of the molecule is greater than 0.40. Those compositions which are condensed with hydrophobic bases to provide a polyoxyalkylene portion having an oxygen/carbon atom ratio greater than 0.40 include ethylene oxide, butadiene dioxide and glycidol, mixtures of these alkylene oxides with each other and with minor amounts of propylene oxide, butylene oxide, amylene oxide, styrene oxide, and other higher molecular weight alkylene oxides. Ethylene oxide, for example, is condensed with the hydrophobic base in an amount sufficient to impart water dispersibility or solubility and surface active properties to the molecule being prepared. The exact amount of ethylene oxide condensed with the hydrophobic base will depend upon the chemical characteristics of the base employed and is readily apparent to those of ordinary skill in the art relating to the synthesis of oxyalkylene surfactant condensates.

Typical hydrophobic bases which can be condensed with ethylene oxide in order to prepare nonionic surface active agents include mono- and polyalkyl phenols, polyoxypropylene condensed with a base having from about 1 to 6 carbon atoms and at least one reactive hydrogen atom, fatty acids, fatty amines, fatty amides and fatty alcohols. The hydrocarbon ethers such as the benzyl or lower alkyl ether of the polyoxyethylene surfactant condensates are also advantageously employed in the compositions of the invention.

Among the suitable nonionic surfactants are the polyoxyethylene condensates of alkyl phenols having from about 6 to 20 carbon atoms in the alkyl portion and from about 5 to 30 ethenoxy groups in the polyoxyethylene radical. The alkyl substituent on the aromatic nucleus may be octyl, diamyl, n-dodecyl, polymerized propylene such as propylene tetramer and trimer, isooctyl nonyl, etc. The benzyl ethers of the polyoxyethylene condensates of monoalkyl phenols impart good properties to the compositions of the invention. A typical product corresponds to the formula:

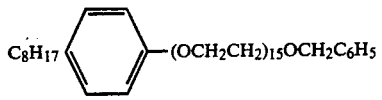

Higher polyalkyl oxyethylated phenols corresponding to the formula:

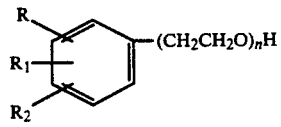

wherein R is hydrogen or an alkyl radical having from about 1 to 12 carbon atoms, $R^1$ and $R^2$ are alkyl radicals having from about 6 to 16 carbon atoms and n has a value from about 10 to 40, are also suitable as nonionic surfactants. A typical oxyethylated polyalkyl phenol is dinonyl phenol condensed with 14 moles of ethylene oxide.

Other suitable nonionic surface-active agents are co-generic mixtures of conjugated polyoxyalkylene compounds containing in their structure at least one hydrophobic oxyalkylene chain in which the oxygen/carbon atoms ratio is greater than 0.40.

Polymers of oxyalkylene groups obtained from propylene oxide, butylene oxide, amylene oxide, styrene oxide, mixtures of such oxyalkylene groups with each other and with minor amounts of polyoxyalkylene groups obtained from ethylene oxide, butadiene dioxide, and glycidol are illustrative of hydrophobic alkylene chains having an oxygen/carbon atoms ratio not exceeding 0.40. Polymers having oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide and styrene oxide are illustrative of hydrophilic oxyalkylene chains having an oxygen/carbon atom ratio greater than 0.40.

Among the conjugated polyoxyalkylene compounds which can be used in the compositions of the invention are those which correspond to the formula:

$$Y(C_3H_6O)_n(C_2H_4O)_mH$$

wherein Y is the residue of an organic compound having from about 1 to 6 carbon atoms and one reactive hydrogen atom, n has an average value of at least about 6.4 as determined by hydroxyl number and m has a value such that the oxyethylene portion constitutes about 20 to 90 weight percent of the molecule. These surface active agents are more particularly described in U.S. Pat. No. 2,677,700, incorporated herein by reference.

Other conjugated polyoxyalkylene surface active agents which are most advantageously used in the compositions of the invention correspond to the formula:

$$Y[C_3H_6O)_n(C_2H_4O)_mH]_x$$

wherein Y is the residue of an organic compound having from about 2 to 6 carbon atoms and containing x reactive hydrogen atoms in which x has a value of at least 2, n has a value such that the molecular weight of the polyoxypropylene hydrophobic base is at least about 900 and m has a value such that the oxyethylene content of the molecule is from about 20 to 90 weight percent. Compounds falling within the scope of the definition for Y include, for example, propylene glycol, glycerine, pentaerythritol, trimethylolpropane, ethylene diamine and the like. As already noted, the oxypropylene chains optionally, but advantageously, contain small amounts of ethylene oxide and the oxyethylene chains contain small amounts of alkylene oxides such as propylene oxide and butylene oxide. These compositions are more particularly described in U.S. Pat. No. 2,674,619, incorporated herein by reference.

Additional conjugated polyoxyalkylene surface active agents which are advantageously used in the compositions of this invention correspond to the formula:

$$P[(C_3H_6O)_n(C_2H_4O_mH]_x$$

wherein P is the residue of an organic compound having from about 8 to 18 carbon atoms and containing x reactive hydrogen atoms in which x has a value of 1 or 2, n has a value such that the molecular weight of the polyoxypropylene portion is at least about 58 and m has a value such that the oxyethylene content of the molecule is from about 10 to 90 weight percent and the formula:

$$P[(C_2H_4O)_n(C_3H_6O)_mH]_x$$

wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of alkylene oxides such as propylene oxide, butylene oxide and higher alkylene oxides containing up to 18 carbon atoms in the alkyl chains.

Thus, cogeneric mixtures of conjugated polyoxyalkylene compounds containing in their structure the residue of an active hydrogen-containing compound and at least one hydrophobic chain of units selected from the group consisting of oxypropylene and oxypropylene-oxyethylene units in which the oxygen/carbon atom ratio does not exceed 0.40 and at least one hydrophilic chain of units selected from the group consisting of oxyethylene and oxyethylene-oxypropylene units in which the oxygen/carbon atom ratio is greater than 0.40 are suitable nonionic surface active agents.

Further suitable nonionic surface active agents are the polyoxyethylene esters of higher fatty acids having from about 8 to 22 carbon atoms in the acyl group and from about 8 to 30 ethenoxy units in the oxyethylene portion. Typical products are the polyoxyethylene adducts of rosin acids, lauric, stearic and oleic acids and the like. Additional nonionic surface active agents are the polyoxyethylene condensates of higher fatty acid amines and amides having from about 8 to 22 carbon atoms in the fatty alkyl or acyl group and about 10 to 30 ethenoxy units in the oxyethylene portion. Illustrative products are coconut oil fatty acid amines and amides condensed with about 10 to 30 moles of ethylene oxide.

Other suitable polyoxyalkylene nonionic surface active agents are the alkylene oxide adducts of higher aliphatic alcohols and thioalcohols having from about 8 to 22 carbon atoms in the aliphatic portion and about 3 to 50 oxyalkylene units in the oxyalkylene portion. Typical products are synthetic fatty alcohols, such as n-decyl, n-undecyl, n-dodecyl, n-tridecyl, n-tetradecyl, n-hexadecyl, n-octadecyl and mixtures thereof condensed with 3 to 50 moles of ethylene oxide; a mixture of normal fatty alcohols condensed with 8 to 20 moles of ethylene oxide and capped with benzyl halide or an alkyl halide; a mixture of normal fatty alcohols condensed with 10 to 30 moles of a mixture of ethylene and propylene oxides; a mixture of several fatty alcohols condensed sequentially with 2 to 20 moles of ethylene oxide and 3 to 10 moles of propylene oxide, in either order; or a mixture of normal fatty alcohols condensed with a mixture of propylene and ethylene oxides, in which the oxygen/carbon atom ratio is less than 0.40, followed by a mixture of propylene and ethylene oxides in which the oxygen/carbon atom ratio is grater than 0.40, or a linear secondary alcohol condensed with 3 to 30 moles or ethylene oxide, or a linear secondary alcohol condensed with a mixture of propylene and ethylene oxides, or a linear secondary alcohol condensed with a mixture of ethylene, propylene, and higher alkylene oxides.

Within the broad disclosure of U.S. Pat. No. 2,674,619, nitrogen-containing polyoxyalkylene compositions are included which are more particularly described in U.S. Pat. No. 2,979,528, incorporated herein by reference. These surfactants possess a unique feature, namely the ability to disperse lime soaps formed by fatty acid soaps in hard water and thus are particularly suitable for use in the surfactant blend of the invention. These compositions are prepared in much the same way as those disclosed above and more particularly in accordance with the procedure disclosed in U.S. Pat. No. 2,674,619 but instead of propylene glycol as initiator, a reactive hydrogen compound containing nitrogen is utilized. Generally, the nitrogen-containing reactive hydrogen compound has up to about six, inclusive, carbon atoms. When the nitrogen-containing reactive hydrogen compound is so defined, there still remains a reasonably broad group of such compounds which can be used. Ammonia, primary amines, alkylene polyamines, alkanolamines, heterocyclic nitrogen compounds are examples of the classes of nitrogen-containing reactive hydrogen compounds which can be used.

Thus, primary amines having not over six carbon atoms such as methylamine, ethylamine, propylamine, butylamine, amylamine, hexylamine and aniline are satisfactory. Alkylene polyamines, especially aliphatic primary diamines, having not over six carbon atoms are the preferred reactive hydrogen compounds since the highest fabric detergency values have been obtained when these were used. These include ethylenediamine, diethylenetriamine, triethylenetetramine, tetraethylenepentamine, hexamethylenediamine, phenylenediamine and the like. Alkanolamines having not over six carbon atoms can be used such as monoethanolamine, diethanolamine, triethanolamine, isopropanolamine, tri(2-propanol)amine, 2-amino-1-butanol, N-butyl-di(2-propanol)amine and the like. Furthermore, heterocyclic nitrogen compounds containing a hetero N atom can be employed, such as piperazine, 2-methylpiperazine, 2,5-dimethylpiperazine, imidazimidazole, pyrazolidine, pyrazolidone, hydantaoin, dimethylhydantoin and the like. Hydroxyl amine and the hydroxylamine derivatives and aminophenol and aminophenol derivatives can also be used.

Useful nitrogen-containing nonionic surfactants are mixtures of conjugated polyoxypropylene-polyoxyethylene compounds based on a nitrogen-containing reactive hydrogen compound wherein chains of oxypropylene groups having a defined molecular weight are attached to the nucleus of the reactive hydrogen compound at the sites of the reactive hydrogen atoms and wherein chains of oxyethylene groups are attached to the end of the oxypropylene chains. The compositions are prepared by condensing propylene oxide with a nitrogen-containing reactive hydrogen compound and subsequently condensing ethylene oxide with the propylene oxide-reactive hydrogen compound condensate.

The collective molecular weight of the oxypropylene chains attached to the nitrogen-containing reactive hydrogen compound must be at least about 900 and can range up to about 25,000 or higher. Since the reactive hydrogen compound employed is one having not more than about six carbon atoms, it is not sufficiently hydrophobic in and of itself so that a detergent would be obtained by simply condensing ethylene oxide with the reactive hydrogen compound. Therefore, the hydrophobic element of the surfact active compositions of the invention necessarily is found in the defined oxypropylene chains. These compositions rely on the hydrophobic oxypropylene chain just as do the compositions of U.S. Pat. No. 2,674,619, but distinguish over the general broad class of compositions disclosed in U.S. Pat. No. 2,674,619 by virtue of the specific class of reactive hydrogen compounds employed. The advantages set forth hereinabove are obtained when the compositions have oxypropylene chains having a molecular weight of at least about 900 and up to 25,000. The preferred detergent compositions are obtained when the molecular weight of the oxypropylene chains is in the range of about 1000 to 15,000. This molecular weight is for the molecular weight of the oxypropylene chains themselves and does not include the molecular weight of the particular reactive hydrogen compound employed.

It is to be noted that it is not necessary to use pure propylene oxide in producing the oxypropylene chains of the detergent compositions, although this is preferred. Small amounts, for example up to about 5 weight percent, of ethylene oxide can be included in the propylene oxide employed to prepare the hydrophobic reactive hydrogen compound-propylene oxide condensate without significant alteration of the detergent properties of the final composition In this connection, the ethylene oxide subsequently condensed with the hydrophobic propylene oxide-reactive hydrogen compound condensate can also contain small amounts, such as up to about 5 weight percent, of propylene oxide without significant alteration of the detergent properties of the compositions of the invention.

It is further to be noted that when molecular weight is stated in this specification and claims, unless otherwise noted, there is meant the average theoretical molecular weight which equals the total of the grams of the alkylene oxide employed per mol of reactive hydrogen compound. It is well recognized in the field of alkylene oxide chemistry that the polyoxyalkylene compositions one obtains by condensing an alkylene oxide with a reactive hydrogen compound are actually mixtures of compounds rather than a single molecular compound. The mixture contains closely related homologues wherein the statistical average number of oxyalkylene groups equals the number of mols of the alkylene oxide employed and the individual members in the mixture contain varying numbers of oxyalkylene groups. Thus, the compositions of this invention are "mixtures" of compounds which are defined by molecular weight of the polyoxyalkylene chains and weight percent of oxyethylene groups.

The nitrogen-containing nonionic surfactants contain chains of oxyethylene groups attached to the oxypropylene chains. The amount of ethylene oxide employed is such that the oxyethylene groups constitute about 10 to 90 weight percent of the final composition. Compositions having outstanding detergent properties are obtained when the weight percent of oxyethylene groups falls within this range. Excellent fabric detergency values at 90° F. have been obtained in such compositions having from about 25 to 55 weight percent of oxyethylene groups.

The Second Nonionic Surfactant

The second nonionic surfactant component of the surfactant blend of the invention is prepared using an initiator which can include the nitrogen-based initiators of U.S. Pat. No. 2,979,528, incorporated herein by reference, but is more broadly defined to include other initiators (1) having about 2 to about 6 carbon atoms and at least 2, preferably 2 to about 6, active hydrogen atoms or (2) having about 6 to about 18 carbon atoms, preferably about 9 to about 11 carbon atoms and at lest one active hydrogen atom, preferably about 1 to about 6 active hydrogen atoms. For instance, hexyl alcohol, octyl alcohol, stearyl alcohol, ethylene diamine, triethylene diamine, hexamethylene diamine and the like, ethylene glycol, propylene glycol, trimethylol propane, pentaerythritol, and erythritol can be utilized as initiators. The second nonionic surfactant has a relatively low cloud point (1 percent by weight aqueous solution).

One significant difference between the surfactants of U.S. Pat. No. 2,979,528 and those used as the second surfactant in the novel blend of surfactants disclosed herein is the sequence in which the block polymer is formed of hydrophilic and hydrophobic alkylene oxides. The conjugated polyoxyethylene-polyoxypropylene block copolymers can be prepared in much the same way as the polymers of U.S. Pat. No. 3,036,118 by first oxyethylating an initiator compound and subsequently oxypropylating the resulting compound to produce the non-ionic surface-active agent, as more completely described in U.S. Pat. No. 3,036,118, incorporated herein by reference.

Useful polyoxyalkylene surfactants having a cloud point in a 1 weight percent aqueous solution of about 10° C. to about 30° C., preferably about 10° C. to about 25° C., and most preferably about 15° C. to about 25° C., which can be blended with a conventional low-foaming nonionic surfactant have the formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

$$Y[(EO/A)_m(EO/A)_n)H]_x \quad \text{IV}$$

wherein EO represents ethylene oxide which is present in the surfactant polymer in the proportion of about 5 to about 60 percent, preferably about 5 to about 25 percent, and most preferably about 5 to about 15 percent by weight; Y represents the nucleus of an active hydrogen-containing organic compound having a functionality x and (1) about 2 to about 6 carbon atoms and at least two reactive hydrogen atoms or (2) abut 7 to about 18 carbon atoms and at least one reactive hydrogen atom; A represents a lower alkylene oxide selected from the group consisting of propylene oxide, butylene oxide, tetrahydrofuran or mixtures thereof; EO/A represents a mixture of ethylene oxide and a lower alkylene oxide in which EO and A are present in the proportions by weight of 5 to 95 to 95 to 5 percent; wherein up to 25 percent by weight of A is reacted directly with said organic compound either alone (in formulas II and III) or in admixture with ethylene oxide (in formulas I and IV) and 75 percent by weight or more of A is subsequently reacted to produce said polymer; m, n and o are integers individually selected such that said polymer has an average total molecular weight generally of about 500 to about 25,000; and wherein said conventional nonionic surfactant and said second nonionic surfactant are each generally present in the individually selected proportion of about 10 to about 90 percent, preferably 25 to about 75 percent, by weight.

Other polyoxyalkylene surfactants having a cloud point in a 1 weight percent aqueous solution of about 10° C. to about 20° C. and preferably about 15° C. to about 20° C., are also useful in blends with conventional low-foaming nonionic surfactants. These have the formula:

$$Y[(EO)_m(A)_nH]_x \quad \text{V}$$

where Y, EO, A, m, n, x, molecular weight and useful proportions are as defined herein for formulas I–IV.

It has been found that certain of these so-called "reverse" polyoxyalkylene block copolymers as defined above, are particularly suitable both as wetting agents and as defoaming agents for proteinaceous soils encountered in machine dishwashing. Useful surfactant compositions result where the proportion of ethylene oxide utilized is about 5 to about 60 percent, preferably about 5 to about 25 percent by weight of the polymer and the total molecular weight of the polymer is generally about 500 to about 25,000, preferably about 1500 to about 20,000, and most preferably about 2500 to about 10,000. Especially preferred are such polymers prepared using an initiator compound characterized as an organic compound having 2 to about 6 carbon atoms and at least two reactive hydrogen atoms, most preferably, 4 to about 6 reactive hydrogen atoms and 2 nitrogen atoms. Representative useful initiators, besides those listed above, include diethylene triamine, triethylene tetramine, and tetraethylene pentamine.

The Builder Salts

The automatic dishwashing detergents to which surfactant compositions of the invention are added in order to reduce foaming of aqueous solutions thereof in the presence of raw egg soil generally contain 20 to 80 weight percent of an alkaline condensed phosphate salt such as tetrasodium pyrophosphate and those polyphosphates of the calcium and magnesium ion sequestering type whose $Na_2O/P_2O_5$ ratios range from 1:1 to 1.67:1 and 20 to 80 weight percent of an alkaline detergent salt such as sodium carbonate, sodium bicarbonate and mixtures thereof, di- and trisodium orthophosphate, sodium metasilicate, sodium sequisiicate, borax and sodium borate. In addition, these detergents often include 5 to 50 weight percent chlorinated trisodium phosphate. A mixture of lithium hypochlorite or chlorinated cyanuric acid and trisodium phosphate can be used in place of chlorinated trisodium phosphate. An automatic dishwashing detergent of this type can be prepared by adding an aqueous silicate solution to substantially anhydrous sodium tripolyphosphate and subsequently adding chlorinated trisodium phosphate thereto under the conditions as described in U.S. Pat. No. 3,359,207, incorporated herein by reference.

Highly alkaline dishwashing detergents containing no silicates can attack, etch, and darken aluminum utensils. Some of these formulations also have a destructive action on over-the-glaze dish patterns. Suitable proportions of silicates in the dishwashing formulations help overcome these difficulties. The silicate used in the compositions of the present invention is preferably solid granular sodium metasilicate, a commercially available material. In the broader aspects of the invention, sodium silicates in which the mole ratio of $SiO_2$:$Na_2O$ are more than 1:1, e.g., 2:1 or 3:2:1, may be used in place of the sodium metasilicate. The sodium silicate generally constitutes from about 20 percent to about 80 percent of the final composition and preferably from about 20 percent to about 40 percent.

Organic sequestering agents can be used in the detergent compositions of the present invention in place of inorganic phosphate salts. Suitable sequestering agents include the various aminocarboxylates, including ethylenediamine tetraacetates (soluble salts, e.g., Na, K, etc.), nitrilotriacetates, and the like.

Alternatively to the use of phosphate bulders, any of the water-soluble metal salts of citric acid can be used in the practice of the present invention. However, all salts do not serve with equal effectiveness, and the alkali metal salts, particularly the sodium and potassium citrates, are preferred. There are three COOH radicals on the citric acid molecule. Commercial "sodium citrate" is fully neutralized and is more accurately described as trisodium citrate. Trisodium citrate is available as white crystals or granular powder. It is odorless, stable in air, and has a pleasant saline taste. Each molecule of trisodium citrate dihydrate loses two molecules of water of hydration when heated to 150° C. Commercial potassium citrate also exists as white crystals or powder. It is normally available as the monohydrate (as contrasted to sodium citrate which exists as the dihydrate).

As used in the present invention, the amount of citrate employed will be within the range of 20 to 80 weight percent on a dry basis (expressed as trisodium citrate). Water of hydration can be considered to be part of the salt. More usually, the amount of citrate (whether hydrated or not) employed will be from 20 to 40 weight percent.

If desired, mixtures of citrates can be used. Although it is not preferred, a citrate can be formed in situ from, for example, the combination of citric acid with sodium or potassium hydroxide. The use of a pre-formed alkali metal citrate or a mixture thereof is particularly preferred with dry blended solid detergents.

The combination of the citrate and the condensed phosphate salt (e.g., sodium tripolyphosphate) appears to result in enhanced activity, and the total of the citrate and the condensed phosphate salt will be in the range of 20 to 80 weight percent on a dry basis and will generally not exceed 65 weight percent (dry basis) of the total composition. Excellent results can be obtained from the combination of sodium tripolyphosphate and sodium citrate when the ratio on a dry weight basis of polyphosphate to citrate is less than about 2:1 but greater than about 0.05:1, i.e., 1:2 to 20:1 citrate:polyphosphate. One method for formulating a detergent composition of this invention is to modify the machine dishwashing detergent formula by replacing more than one-third of the condensed phosphate salt with citrate; provided, of course, that the condensed phosphate content is reduced below 35 percent on a dry weight basis.

Although the alkali metal citrates can be chelating agents and are known to have some water conditioning effects, these compounds are not particularly effective sequestering agents at alkaline pH levels. Nor are the citrates themselves known to be particularly outstanding in performing the variety of functions, in addition to sequestering attributed to sodium tripolyphosphate (buffering, de-flocculation, solubilizing or peptizing, etc.).

However, one-third, one-half, or even nine-tenths or more of the polyphosphate can be replaced by citrate with little or no significant loss in overall performance characteristics of the detergent composition. Although this invention is not bound by any theory, it appears that so long as sufficient condensed alkali metal phosphate is present to maintain a threshold effect, the citrate is an effective substitute for the remainder of the polyphosphate that would normally be present in a machine dishwashing detergent. However, partial replacement of condensed alkali metal phosphate with other carboxylic acid salt water conditioning agents (e.g., gluconate salts) does not appear to provide the same performance as the partial replacement with citrates.

When citrates are formed in situ from citric acid in compositions of the present invention, either solid or dissolved citric acid can be used. Commercially available aqueous citric acid solutions at concentrations of about 25 to 40 percent by weight are suitable.

The Chlorine Releasing Agents

Another ingredient of the detergent compositions of this invention is an active chlorine-containing compound or an oxygen-releasing bleaching agent. The active chlorine-containing compound imparts germicidal and bleaching action to the detergent compositions. Active chlorine-containing compounds which may be employed in accordance with this invention include chlorinated trisodium phosphate, trichlorocyanuric acid, sodium salt of dichlorocyanuric acid, potassium salt of dichlorocyanuric acid, o-sodium hypochlorite and 1,3-dichloro-5,5-dimethylhydantoin. Based on 100 parts of detergent composition, 5 to 50 parts of active chlorine-containing compound may be employed. If chlorinated trisodium phosphate is employed, then from 10 to 25 parts of the chlorine compound are preferred since the amount of chlorine available in chlorinated trisodium phosphate is only 0.325 part per part of compound. Much higher amounts of chlorine are available in the chlorinated cyanuric acids and, therefore, when they are employed from five to ten parts of active chlorine compound are preferred.

Test Methods

The foam characteristics of the detergent compositions were measured by observing the rate of rotation of the perforated spray arm of an automatic dishwashing machine during the washing cycle in which raw egg soil and/or milk soil and detergent were present in definitive quantities. The rate of rotation of the spray arm is, of course, inversely proportional to the amount of foam present. In each of the subsequent examples, foam evaluation was carried out in a Hobart Kitchen Aid dishwasher. The procedure followed was to turn on the machine and, after part of the water had been added, turn off the machine and add the detergent composition and additives, if any, and 15 cc. of raw egg and/or 15 grams of milk soil. The dishwasher was then turned on again and the balance of the water added. The water was at a temperature of about 120° F. or about 140° F. After the washing cycle started, the rate of rotation of the perforated spray arm was measured from the first to the second minute and from the third to the fourth minute. In the presence of excess foam, the rotor arm stopped or the foam overflowed. A spray arm rotation of about 70 r.p.m. or more is indicative that foam formation is being subsequently depressed.

The following examples illustrate the various aspects of the invention but are not intended to limit its scope. Where not otherwise specified throughout this specification and claims, temperatures are given in degrees centigrade and parts, percentages, and proportions are by weight.

EXAMPLE 1

A machine dishwashing detergent was prepared utilizing a blend of two nonionic surfactants for a total weight of 3 percent of surfactant, tetrasodium pyrophosphate 35 percent by weight, sodium tripolyphosphate 20 percent by weight, sodium metasilicate pentahydrate 10 percent by weight, chlorinated trisodium phosphate 20 percent by weight, and water 12 percent by weight. A conventional 3600 molecular weight heteric polyol was employed. This is prepared by condensing a mixture of ethylene oxide and propylene oxide in a weight ratio of ethylene oxide to propylene oxide of 9:1 with a 2700 molecular weight condensation product of trimethylolpropane and a mixture of propylene oxide and ethylene oxide in a weight ratio of propylene oxide to ethylene oxide of 9:1. The second nonionic surfactant was a block polyol having a molecular weight of about 8000 prepared by condensing a mixture of ethylene oxide and propylene oxide in a weight ratio of propylene oxide to ethylene oxide of 9:1 with the tetrafunctional initiator N,N,N',N'-tetrakis(2-hydroxypropyl)ethylenediamine. The proportion of the conventional surfactant to the second surfactant is 9:1 by weight.

The detergent is prepared by blending an aqueous mixture of the surfactant with the phosphate ingredients. The blending can be accomplished in any manner such as by pouring or spraying. By combining the phosphate ingredient with the surfactant, the hydration of the phosphate occurs in the presence of the surfactant which is simultaneously absorbed by the phosphate ingredient. This also protects the surfactant from the action of the metasilicate and the chlorinated compound which are subsequently added. Thereafter, the sodium metasilicate pentahydrate is added while the mixture is constantly mixing. Next, the detergent mixture is reduced to any desired particle size by any conventional means such as crushing, grinding and, preferably, screening. Generally, when the mixture is screened, a 5-mesh to 25-mesh screen is used, as this size particle is most appropriate for automatic machine dishwashing operations. Chlorinated trisodium phosphate is next added to the screened mixture. Alternatively, this compound can be added together with the sodium metasilicate pentahydrate. Preferably, the chlorinated trisodium phosphate is added when no moisture is present and therefore, it is desirable to add the chlorinated trisodium phosphate subsequent to the addition of the sodium metasilicate pentahydrate.

The dishwasher detergent was evaluated at a concentration of 0.3 percent by weight in accordance with the procedure described above utilizing an automatic dishwashing machine in which raw egg soil and milk soil were successively utilized in measured amounts. The water temperature was maintained in one test at 120° F. and in a second test at 140° F. The test results indicate fair performance for the machine dishwashing detergent of Example 1 at either 120° F. or 140° F. water temperatures.

EXAMPLE 2

Example 1 was repeated except that the surfactant component was a blend of the second surfactant of Example 1 with the conventional surfactant of Example 1 in the respective weight proportion of 9:1. Evaluation of the detergent composition utilizing an automatic dishwashing machine in accordance with the above procedure indicated the detergent provided excellent foam suppression and excellent detergency.

EXAMPLE 3

The machine dishwashing detergent of Example 1 was prepared except that the surfactant blend was an equal parts by weight mixture of the conventional surfactant of Example 1 and the second surfactant of Example 1. Evaluation in accordance with the procedure above in a machine dishwasher resulted in a rating of excellent at both 140° and 120° F. water temperature conditions.

EXAMPLE 4

The conventional nonionic surfactant of Example 1 was blended with the second surfactant of Example 1 in the respective weight proportion of 9:1 and utilized together with a non-phosphate builder to prepare a machine dishwashing detergent. The nonionic surfactant blend was utilized in the amount of 5 percent by weight and blended with 30 percent by weight sodium citrate, 20 percent by weight sodium carbonate, 30 percent by weight sodium metasilicate pentahydrate, 11 percent by weight sodium sulfate, and 4 percent by weight chlorinated cyanurate. The mixture was reduced to appropriate particle size using a 25 mesh screen and evaluated as a machine dishwashing detergent in accordance with the procedure described above wherein milk soil and egg soil were utilized in measured amounts for comparative testing of the effectiveness of the machine dishwashing detergent. Evaluation using a water temperature of 120° F. or 140° F. indicates fair performance in a machine dishwasher.

EXAMPLE 5

Example 4 was repeated using the surfactant blend of Example 4 in the proportion of 1 part by weight of the conventional nonionic surfactant of Example 4 with 9 parts by weight of the second surfactant of Example 4. Evaluation in a machine dishwasher in accordance with the procedure described above, indicates excellent performance both at a water temperature of 120° F. and 140° F.

EXAMPLE 6

Example 4 was repeated except that the weight ratio of conventional nonionic surfactant to the second surfactant was 1:1 by weight. Evaluation utilizing a machine dishwasher in accordance with the procedure described above indicates excellent performance both at water temperatures of 120° F. and 140° F.

EXAMPLE 7

(Control—Forming No Part Of This Invention)

The machine dishwashing detergent of Example 1 was prepared except that the surfactant utilized was a blend of the conventional nonionic surfactant of Example 1 in the amount of 97 parts by weight with 3 parts by weight of monostearyl-acid phosphate, the preparation of which is described in U.S. Pat. No. 3,314,891, incorporated herein by reference. Evaluation of this detergent in a machine dishwsher utilizing the procedure described above both at a water temperature of 120° F. and 140° F. utilizing a concentration of the detergent in water of 0.3 percent by weight resulted in a determination that the detergent provides excellent results in foam control and detergency at both operating temperatures.

EXAMPLES 9-11

Examples 1-3 were repeated substituting a detergent similar to the second nonionic detergent except having a molecular weight of about 5000. Performance evaluation both at 120° F. and 140° F. water temperatures in a machine dishwasher in accordance with the procedures described above, resulted in similar determinations for foam control and detergency as reported for Examples 1-3, i.e., the performance of Example 9 was similar to that of Example 1, Example 10's performance was similar to that of Example 2, etc.

In the following tables, there are tabulated the results of the evaluation of certain of the detergents prepared in the Examples utilizing a machine dishwasher in accordance with the procedure described above. Table I lists the performance at a water temperature of 120° F. and Table II lists the performance of detergents utilized at a water temperature of 140° F. In all evaluations, the concentration of detergent in the water was 0.3 percent by weight.

TABLE I

Machine Dishwasher Evaluation
(Water Temperature - 120° F.; Concentration of Detergent 0.3 Percent by Weight)

| | Spray Arm Speed (rpm) | | |
|---|---|---|---|
| Example | No Soil | Egg Soil | Milk Soil |
| 1 | 79 | 62 | 60 |
| 3 | 86 | 72 | 74 |
| 7 (control) | 70 | 56 | |
| 8 (control) | 86 | 71 | 73 |

TABLE II

Machine Dishwasher Evaluation
(Water Temperature - 140° F.; Concentration of Detergent 0.3 Percent by Weight)

| | Spray Arm Speed (rpm) | | |
|---|---|---|---|
| Example | No Soil | Egg Soil | Milk Soil |
| 1 | 78 | 57 | 62 |
| 3 | 85 | 73 | 73 |
| 7 (control) | 66 | 50 | 53 |
| 8 (control) | 84 | 73 | 70 |

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

The embodiments of the invention in which an exclusive privilege or property is claimed are defined as follows:

1. A low-foaming homogeneous, nonionic surfactant blend consisting essentially of a blend of
   A. at least one conventional polyoxyalkylene-based low-foaming nonionic surfactant and
   B. a second nonionic surfactant consisting of a block or heteric/block polyoxyalkylene having a cloud point in a 1 weight percent aqueous solution of about 10° C. to about 30° C. selected from the group consisting of at least one of the polyoxyalkylenes having the formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

$$Y[(EO/A)_m(EO/A)_nH]_x \quad \text{IV}$$

wherein EO represents ethylene oxide which is present in the polymer in the proportion of about 5 to about 60 percent by weight; Y represents the nucleus of an active hydrogen-containing organic compound having a functionality of x and (1 ) about 2 to about 6 carbon atoms and at least two reactive hydrogen atoms or (2) about 7 to about 18 carbon atoms and at least one reactive hydrogen atom; A represents a lower alkylene oxide selected from the group consisting of propylene oxide, butylene oxide, tetrahydrofuran or mixtures thereof wherein up to 25 percent by weight of A is reacted directly with said organic compound either alone in formulas II and III or in admixture with ethylene oxide in formulas I and IV and 75 percent by weight or more of A is subsequently reacted to produce said polymer; m, n and o are integers individually selected such that the average total molecular weight of the polymer is about 500 to about 25,000; and wherein said conventional nonionic surfactant is present in the proportion of about 10 to about 90 percent by weight and said second nonionic surfactant is present in the proportion of about 10 to about 90 percent by weight or C. a second nonionic surfactant characterized as a block polyoxyalkylene having a cloud point of about 10° C. to about 20° C. selected from the group consisting of at least one of the polyoxyalkylenes having the formula $$Y[(EO)_m(A)_nH]_x \qquad V$$

wherein Y, EO, A, m, n, x, molecular weight, and useful proportions are as defined above.

2. The surfactant blend of claim 1 wherein said conventional nonionic low-foaming surfactant is selected from the group consisting of heteric, block and heteric/block copolymers of ethylene oxide and a second lower alkylene oxide prepared using initiators having about 2 to about 6 active hydrogen atoms.

3. The composition of claim 2 wherein said low-foaming conventional nonionic surfactant is selected from the group consisting of polyoxyethylene condensates of alkyl phenols having from about 6 to 20 carbon atoms in the alkyl portion, the benzyl ethers of said polyoxyethylene condensates of alkyl phenols;

cogeneric mixtures of conjugated polyoxyalkylene compounds containing in their structure the residue of an active hydrogen-containing compound and at least one hydrophobic chain of units selected from the group consisting of oxypropylene and oxypropylene-oxyethylene units in which the oxygen/carbon atom ratio does not exceed 0.40 and at least one hydrophilic chain of units selected from the group consisting of oxyethylene and oxyethylene-oxypropylene units in which the oxygen/carbon atom ratio is greater than 0.40;

polyoxyethylene esters of higher fatty acids having from about 8 to 22 carbon atoms in the acyl group;

polyoxyethylene condensates of higher fatty amines having from about 8 to 22 carbon atoms in the fatty alkyl group;

polyoxyethylene condensates of higher fatty amides having from about 8 to 22 carbon atoms in the fatty acyl group; and alkylene oxide adducts of higher aliphatic compounds selected from the group consisting of alcohols and thioalcohols having from about 8 to 22 carbon atoms in the aliphatic portion and 3–50 oxyalkylene units.

4. The composition of claim 3 wherein said cogeneric mixtures of conjugated polyoxyalkylene compounds contain in their structure the residue of an active hydrogen-containing compound having at least three active hydrogens which is first polymerized utilizing a mixture of about 90 percent by weight of a lower alkylene oxide selected from the group consisting of propylene oxide, butylene oxide and mixtures thereof, and about 10 percent by weight of ethylene oxide to obtain a molecular weight of about 2700 and subsequently polymerizing a mixture of about 10 percent of lower alkylene oxide selected from the group consisting of propylene oxide, butylene oxide and mixtures thereof, and about 90 percent by weight of ethylene oxide to obtain a molecular weight of about 3600.

5. The composition of claim 4 wherein said second nonionic surfactant is a low-foaming nonionic surfactant having a cloud point in a one percent by weight aqueous solution of about 15° C. to about 25° C. and the formula $$Y[(PO)_o(EO)_m(PO)_nH]_x$$

wherein Y is an active hydrogen-containing initiator having at least 3 active hydrogens, PO is propylene oxide, the total proportion by weight of ethylene oxide in the polymer is about 5 to 15 percent by weight, x is an integer of 2 to 6, and the total molecular weight is about 1500 to about 20,000.

6. The composition of claim 5 wherein Y is an active hydrogen-compound containing 4 active hydrogens selected from the group consisting of ethylenediamine, triethylenedimine, hexamethylenediamine, pentaerythritol, erythritol and mixtures thereof and the total molecular weight is about 2500 to about 10,000.

7. The composition of claim 6 wherein Y is ethylenediamine and the total molecular weight is about 8000.

8. A low-foaming alkaline machine dishwashing detergent composition devoid of alkyl phosphate ester consisting essentially of A. about 1 to about 10 percent by weight of a homogenous surfactant blend of claim 1;

B. about 20 to about 80 percent by weight of an alkaline detergent salt selected from at least one of the group consisting of sodium carbonate, sodium bicarbonate, disodium orthophosphate, trisodium orthophosphate, sodium metasilicate, sodium sesquisilicate, sodium borate, sodium tetraborate, sodium aluminum silicate, and sodium bisulfate;

C. about 20 to about 80 percent by weight of (1) a water-soluble metallic salt of citric acid or an organic sequestering agent selected from the group consisting of at least one of tetrasodium ethylene diamine tetraacetate and a water-soluble metal salt of nitrilotriacetic acid or (2) alternatively, an alkaline condensed phosphate salt selected from the group consisting of at least one of tetrasodium pyrophosphate and those polyphosphates of the calcium and magnesium ion sequestering type having $Na_2O/P_2O_5$ weight ratios ranging from 1:1 to 1.67:1, or (3) mixtures of (1) and (2); and D. about 5 to about 50 percent by weight of at least one compound containing active chlorine or available oxygen.

9. The composition of claim 8 wherein said detergent contains the low-foaming surfactant blend of claim 1; an alkaline condensed phosphate salt; and an active chlorine-containing compound selected from at least one of the group consisting of chlorinated trisodium phosphate, chlorinated cyanuric acid and alkali metal salts thereof, and 1,3-dichloro-5,5-dimethylhydantoin, and wherein said detergent additionally contains about 1 to about 20 percent by weight of water and about 1 to about 10 percent by weight of filler.

10. The composition of claim 8 wherein said surfactant blend is the composition of claim 2.

11. The composition of claim 8 wherein said low-foaming nonionic surfactant blend is the composition of claim 5.

12. The composition of claim 8 wherein said nonionic surfactant blend is the composition of claim 6.

13. The composition of claim 8 wherein said nonionic surfactant blend is the composition of claim 7.

14. The process of washing food-soiled utensils in a machine dishwsher comprising contacting said utensils with an aqueous solution of about 0.2 to about 1 percent by weight of the detergent composition of claim 8 at a water temperature of about 100° F. to about 180° F.

15. The process of claim 14 wherein said food soil comprises egg and/or proteinaceous soil derived from milk products.

16. The process of washing food-soiled utensils in a machine dishwasher comprising contacting said utensils with an aqueous solution of about 0.2 to about 1 percent by weight of a detergent composition which is devoid of alkyl phosphate ester comprising about 1 to about 10 percent by weight of the homogeneous blend of nonionic surfactants of claim 1; about 20 to about 80 percent of a nonphosphate or phosphate salt builder selected from the group consisting of at least one of a water-soluble metallic salt of citric acid, ethylene diamine tetraacetate or the water-soluble salts thereof; nitrilotriacetates, sodium tripolyphosphate, tetrasodium pyrophosphate, and those polyphosphates of the calcium and magnesium ion sequestering type having $Na_2O/P_2O_5$ ratios ranging from 1:1 to 1.67:1, about 5 to about 50 percent by weight of an active chlorine-containing compound or an oxygen-releasing bleaching agent; and optionally, about 1 to about 20 percent by weight of water and about 1 to about 10 percent by weight of filler.

17. The process of claim 16 wherein said builder comprises a phosphate salt selected from the group consisting of at least one of sodium tripolyphosphate, tetrasodiumpyrophosphate, and polyphosphates of the calcium and magnesium ion sequestering type whose $Na_2O/P_2O_5$ weight ratios range from 1:1 to 1.67:1 and said active chlorine-containing compound is selected from the group consisting of at least one of chlorinated trisodium phosphate, chlorinated cyanuric acid and the alkali metal salts thereof, and 1,3-dichloro-5,5-dimethylhydantoin.

18. The process of claim 17 wherein said low-foaming surfactant blend consists essentially of the composition of claim 2, 3, 4, 5, 6, or 7 and said builder is a mixture of sodium tripolyphosphate and tetrasodium pyrophosphate and said active chlorine-containing compound is chlorinated trisodium phosphate.

* * * * *